US008052254B2

(12) United States Patent
Essen

(10) Patent No.: US 8,052,254 B2
(45) Date of Patent: Nov. 8, 2011

(54) MANIFOLD FOR A PRINTHEAD

(75) Inventor: Kevin Von Essen, San Jose, CA (US)

(73) Assignee: FUJIFILM Corporation, Tokyo (JP)

( * ) Notice: Subject to any disclaimer, the term of this patent is extended or adjusted under 35 U.S.C. 154(b) by 374 days.

(21) Appl. No.: 12/416,787

(22) Filed: Apr. 1, 2009

(65) Prior Publication Data

US 2010/0253742 A1 Oct. 7, 2010

(51) Int. Cl.
*B41J 2/17* (2006.01)

(52) U.S. Cl. ..... 347/84; 347/85

(58) Field of Classification Search ..... 347/40, 347/43, 64–65, 84–86
See application file for complete search history.

(56) References Cited

U.S. PATENT DOCUMENTS

| | | | |
|---|---|---|---|
| 6,540,340 | B2 | 4/2003 | Thorpe et al. |
| 7,281,785 | B2 | 10/2007 | Palifka et al. |
| 2006/0232644 | A1 | 10/2006 | Graveson et al. |
| 2008/0055378 | A1 | 3/2008 | Drury et al. |

FOREIGN PATENT DOCUMENTS

| | | |
|---|---|---|
| JP | 2005-53047 | 3/2005 |
| WO | 2009/142889 | 11/2009 |

OTHER PUBLICATIONS

Japanese Patent Application No. FE08-03549.

*Primary Examiner* — Lamson Nguyen
(74) *Attorney, Agent, or Firm* — Fish & Richardson P.C.

(57) ABSTRACT

A printhead assembly is described including multiple printheads, a manifold and multiple inlet tubes. The printheads each include: a fluid inlet to receive fluid into the printhead; and a set of one or more nozzles to deposit fluid on a substrate. The manifold is connected to the printheads and includes: a fluid inlet duct configured to receive fluid for delivery to the printheads; multiple fluid inlet channels for connecting the fluid inlet duct to the printheads; and multiple fluid inlet valves configured to control a flow of fluid from the fluid inlet duct to each of the fluid inlet channels. The inlet tubes each have a proximal end integral to either the manifold or one of the printheads, and a distal end connected to either the manifold or said printhead with a single fluid-tight connection.

15 Claims, 6 Drawing Sheets

MANIFOLD FOR A PRINTHEAD

TECHNICAL FIELD

The following description relates to a fluid ejection system for printing.

BACKGROUND

A fluid ejection system, for example, an ink jet printer, typically includes an ink path from an ink supply to a printhead that includes nozzles from which ink drops are ejected. Ink is just one example of a fluid that can be ejected from a jet printer. Ink drop ejection can be controlled by pressurizing ink in the ink path with an actuator, for example, a piezoelectric deflector, a thermal bubble jet generator, or an electrostatically deflected element. A typical printhead has a line or an array of nozzles with a corresponding array of ink paths and associated actuators, and drop ejection from each nozzle can be independently controlled. In a so-called "drop-on-demand" printhead, each actuator is fired to selectively eject a drop at a specific location on a medium. The printhead and the medium can be moving relative one another during a printing operation.

Ink is provided to a printhead from a source that can be internal or external to the fluid ejection system. The longer the flow path from the ink source to the printhead and the greater the number of connections required along the path, the greater chance of air bubbles becoming entrapped in the ink. Air bubbles can have a detrimental effect on printing quality from the printhead. Air bubbles can become entrapped during a filling operation or during a printing operation through leaks along the length of the flow path.

SUMMARY

This invention relates to a printhead assembly for a fluid ejection system. In general, in one aspect, the invention features a printhead assembly including multiple printheads, a manifold and multiple inlet tubes. The multiple printheads each include: a fluid inlet to receive fluid into the printhead; and a set of one or more nozzles to deposit fluid on a substrate. The manifold is connected to the multiple printheads. The manifold includes: a fluid inlet duct configured to receive fluid for delivery to the printheads; multiple fluid inlet channels, each fluid inlet channel connecting the fluid inlet duct to one of the printheads; and multiple fluid inlet valves, each valve configured to control a flow of fluid from the fluid inlet duct to one of the fluid inlet channels. Each of the multiple inlet tubes has a proximal end integral to either the manifold or one of the printheads, and a distal end connected to either the manifold or said printhead with a fluid-tight connection. Each inlet tube connects a fluid inlet channel of the manifold to a fluid inlet of said printhead with a single fluid-tight connection.

Implementations of the printhead assembly can include one or more of the following features. The manifold can have a dimension m in a direction parallel to a length dimension of the inlet tubes, where a length of a flow path extending from the fluid inlet duct to the fluid inlet of each printhead does not exceed approximately one-and-a-half times the dimension m. In other implementations, the length of the flow path extending from the fluid inlet duct to the fluid inlet of each printhead does not exceed approximately two times the dimension m. Each inlet tube can have the proximal end formed integral to one of the printheads and a seal (e.g., a radial seal) can provide a fluid-tight connection between the distal end of each inlet tube and the manifold. In other implementations, each inlet tube can have the proximal end formed integral to the manifold and a seal can provide a fluid-tight connection between the distal end of each inlet tube and one of the printheads.

Each of the fluid inlet valves can be a solenoid valve. At least some of the solenoid valves can be connected to a first surface of the manifold that is positioned opposite a second surface of the manifold that is connected to the printheads. In other implementations, at least some of the solenoid valves can be connected to a first surface of the manifold that is positioned substantially perpendicular to a second surface of the manifold that is connected to the printheads. The printhead assembly can further include multiple inlet motors, each inlet motor controlling one of the fluid inlet valves. By way of example, a fluid inlet valve can include a ball valve or a servo valve.

In general, in another aspect, the invention features a printhead assembly including multiple printheads. Each printhead includes: a fluid inlet to receive fluid into the printhead; a set of one or more nozzles to deposit fluid on a substrate; and a fluid outlet to remove fluid from the printhead. The printhead assembly further includes a manifold connected to the printheads. The manifold includes: a fluid inlet duct configured to receive fluid for delivery to the printheads; a fluid outlet duct configured to receive fluid from the printheads; multiple fluid inlet channels, each fluid inlet channel connecting the fluid inlet duct to one of the printheads; multiple fluid outlet channels, each fluid outlet channel connecting the fluid outlet duct to one of the printheads; multiple fluid inlet valves, each valve configured to control a flow of fluid from the fluid inlet duct to one of the fluid inlet channels; and multiple fluid outlet valves, each valve configured to control a flow of fluid from the fluid outlet duct to one of the fluid outlet channels. The printhead assembly further includes multiple inlet tubes, each inlet tube having a proximal end integral to either the manifold or one of the printheads and a distal end connected to either the manifold or said printhead with a fluid-tight connection. Each inlet tube connects a fluid inlet channel of the manifold to a fluid inlet of one of the printheads with a single fluid-tight connection. The printhead assembly further includes multiple outlet tubes, each outlet tube having a proximal end integral to either the manifold or one of the printheads and a distal end connected to either the manifold or said printhead with a fluid-tight connection. Each outlet tube connects a fluid outlet channel of the manifold to a fluid outlet of one of the printheads with a single fluid-tight connection.

Implementations of the printhead assembly can include one or more of the following features. The manifold can have a dimension m in a direction parallel to a length dimension of the inlet tubes, where a length of a flow path extending from the fluid inlet duct to the fluid inlet of each printhead does not exceed approximately one-and-a-half times the dimension m. In other implementations, the length of the flow path extending from the fluid inlet duct to the fluid inlet of each printhead does not exceed approximately two times the dimension m. The fluid inlet duct can be positioned above the fluid outlet duct such that a pressure differential exists between the fluid inlet and outlet ducts.

In general, in another aspect, the invention features a method. The method includes (a) closing all of multiple fluid inlet valves in a manifold connected to multiple printheads, except for a first fluid inlet valve connected to a first printhead. The manifold includes: a fluid inlet duct configured to receive fluid for delivery to the printheads; multiple fluid inlet channels, each fluid inlet channel connecting the fluid inlet duct to one of the printheads; and multiple fluid inlet valves, each valve configured to control a flow of fluid from the fluid inlet duct to one of the fluid inlet channels. The method further includes (b) filling the first printhead with fluid flowing from the fluid inlet duct into a first fluid inlet channel corresponding to the first printhead and into the open first fluid inlet valve.

Implementations of the method can include one or more of the following features. The method can further include: (c) determining the first printhead is filled with the fluid and closing the first fluid inlet valve; and, (d) repeating the steps (a) through (c) above until each printhead is filled with the fluid. The manifold can be connected to each of the printheads by a single fluid-tight inlet connection per printhead. The manifold can have a dimension m in a direction parallel to a direction of flow of fluid into the printheads, where a length of each flow path extending from the fluid inlet duct to a fluid inlet at each of the printheads does not exceed approximately two times the dimension m.

The manifold can further include a fluid outlet duct configured to receive fluid from the printhead; multiple fluid outlet channels, each fluid outlet channel connecting the fluid outlet duct to one of the printheads; and multiple fluid outlet valves, each valve configured to control a flow of fluid from the fluid outlet duct to one of the fluid outlet channels. The method can further include in step (a), closing all of the fluid outlet valves in the manifold. The manifold can be connected to each of the printheads by a single fluid-tight inlet connection and a single fluid-tight outlet connection per printhead.

In general, in another aspect, the invention features a method including: (a) closing all of multiple fluid inlet valves in a manifold connected to multiple printheads, except for a first fluid inlet valve connected to a first printhead; and (b) circulating fluid into the first printhead until air bubbles and/or contaminants are purged from the first printhead through nozzles included in the first printhead. The manifold includes: a fluid inlet duct configured to receive fluid for delivery to the printheads; multiple fluid inlet channels, each fluid inlet channel connecting the fluid inlet duct to one of the printheads; and multiple fluid inlet valves, each valve configured to control a flow of fluid from the fluid inlet duct to one of the fluid inlet channels.

Implementations of the method can include one or more of the following features. The method can further include, after circulating fluid into the first printhead, closing the first fluid inlet valve, and repeating the steps (a) through (b) above for each printhead until each printhead is purged of air bubbles and/or contaminants. The manifold can further include: a fluid outlet duct configured to receive fluid from the printheads; multiple fluid outlet channels, each fluid outlet channel connecting the fluid outlet duct to one of the printheads; and multiple fluid outlet valves, each valve configured to control a flow of fluid from the fluid outlet duct to one of the fluid outlet channels. The method can further include: closing all of the fluid outlet valves except for a first fluid outlet valve connected to the first printhead; and circulating fluid into and out of the first printhead.

Implementations of the invention can realize one or more of the following advantages. The distance between the inlet duct of the manifold and the inlet to a printhead is relatively short and can include a single fluid-tight connection. Reducing the length of the flow path and minimizing the number of fluid-tight connections can reduce the entrapment of air bubbles in the fluid. Reducing air bubbles can improve the print quality from the printhead. In implementations using a fluid recirculation scheme, an additional single fluid-tight connection can be used to connect the printhead to the outlet duct in the manifold, again minimizing the number of required connections. By using inlet and outlet tubes integral to either the printhead or the manifold to provide the connection between these two components, the fluid path can be relatively straight (i.e., without corners or other connections), which also reduces the risk of air entrapment in the fluid. Connecting the printhead to the manifold is facilitated, since there are a reduced number of fluid connections to be made and reduced possible leak failures. Overall, the system can require less fluid volume, due to shorter fluid paths, which can also be an advantage.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
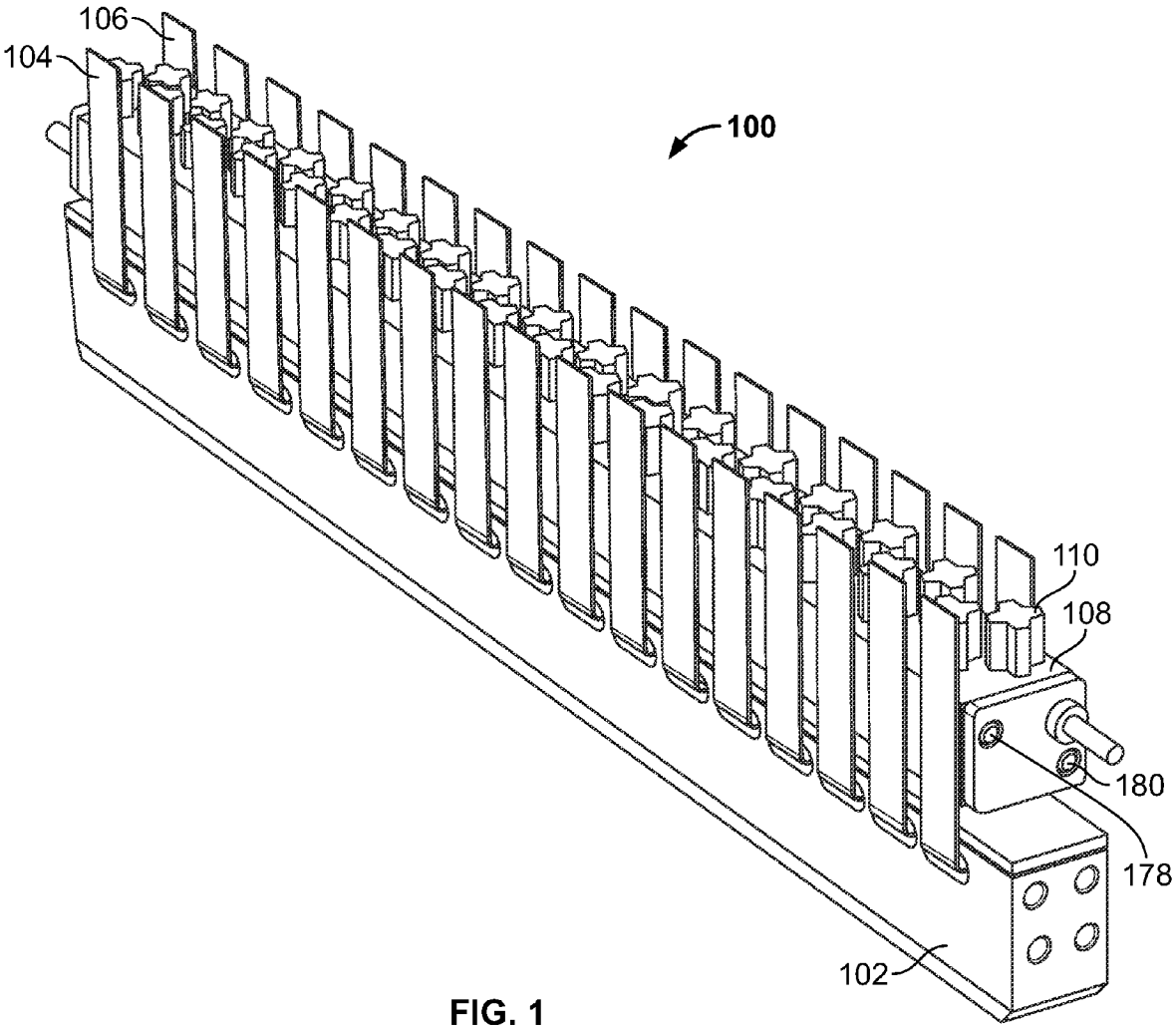
FIG. 1 is a perspective view of an example manifold connected to multiple printheads mounted to a frame.

Multiple printheads can be arranged adjacent one another to provide a wider spanning array of nozzles. FIG. 1 shows an example fluid ejection system 100 that includes multiple printheads mounted to a frame 102. Rows of flexible circuits 104 and 106 are shown extending upwardly from either side of the frame. Each pair of flexible circuits, i.e., where one circuit from row 104 and one circuit from row 106 form a pair, is electrically connected to a printhead mounted within the frame 102. A manifold 108 is positioned above the frame 102 and includes an inlet fluid duct configured to provide a printing fluid to each of the printheads. In the implementation shown, multiple valves 110 (in this example, solenoid valves) are positioned on top of the manifold 108, where an individual valve 110 can control the flow of fluid from the inlet fluid duct to an individual printhead.

In implementations where the printheads include a recirculation system, such that some of the fluid provided to the printhead is circulated back out of the printhead if not used during a printing operation, the manifold can also include an outlet fluid duct configured to transport fluid away from the printheads.

Figure 2:
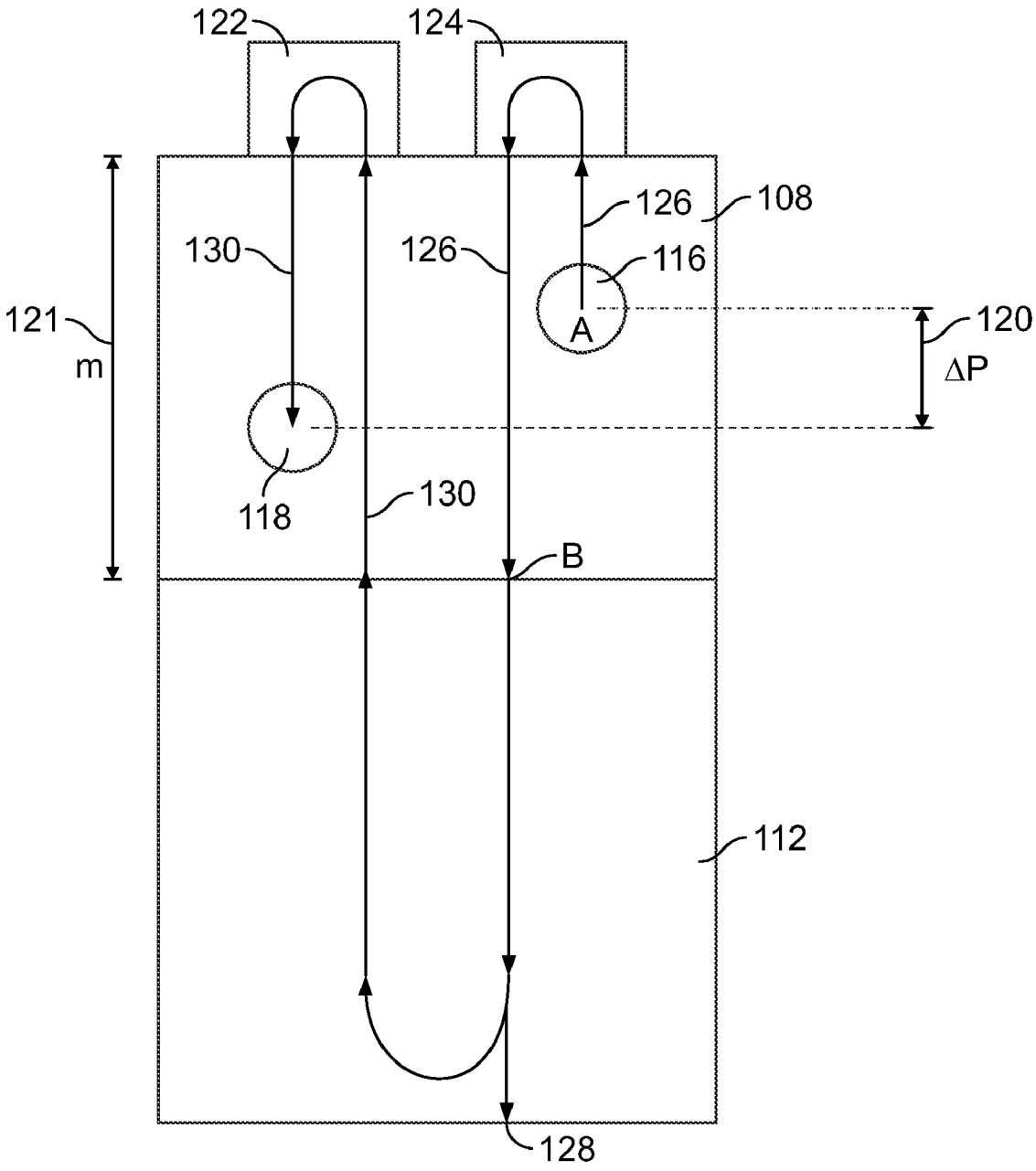
FIG. 2 is a simplified schematic representation of a fluid flow path through the manifold of FIG. 1 and an example printhead.

FIG. 2 is a simplified schematic representation showing a cross-sectional end view of the manifold 108 attached to a printhead 112 and illustrating a flow path of fluid. In this example, the manifold 108 includes an inlet fluid duct 116 and an outlet fluid duct 118. The inlet fluid duct 116 is positioned vertically above the outlet fluid duct 118 such that a pressure differential exists between the two ducts, as is illustrated by the dimension 120. The pressure differential ($\Delta P$)

between the inlet and outlet fluid ducts 116, 118 creates a pressure differential across each printhead that is in fluid communication with the inlet and outlet fluid ducts 116, 118. Ink thereby flows into each printhead, for example printhead 112, from the inlet fluid duct 116, circulates through the printhead—some of the ink being consumed by printing operations—and exits the printhead into the outlet fluid duct 118; the inlet pressure being higher than the outlet pressure.

In the example implementation shown, two solenoid valves 122 and 124 are positioned on top of the manifold 108. Valve 122 is connected to outlet fluid duct 118 and valve 124 is connected to the inlet fluid duct 116. The valves 122, 124 are operable to open and close the flow of fluid as between the outlet and inlet fluid ducts 118, 116 respectively and the printhead 112. In the implementation shown, the fluid originates from a fluid source, which can be internal or external to the fluid ejection system 100. Fluid from the fluid source is provided to the inlet fluid duct 116, which extends all or substantially all of the length of the manifold 108. Fluid from the inlet fluid duct 116 flows from a point "A" up a first portion of a fluid inlet channel 126 into the inlet solenoid valve 124. When the valve 124 is open, the fluid then flows down a second portion of the fluid inlet channel 126 and into a fluid inlet (point "B") of the printhead 112.

Some of the fluid provided to the printhead 112 can be consumed by printing operations, i.e., ejected from one or more nozzles as illustrated by the flow path at point 128. Any remaining fluid circulates out of the printhead 112 from a fluid outlet and into a first portion of a fluid outlet channel 130 in the manifold 108. The fluid flows up the fluid outlet channel 130 and into the outlet solenoid valve 122. If the valve 122 is open, then the fluid flows down a second portion of the fluid outlet channel 130 and into the outlet fluid duct 118. The outlet fluid duct 118 extends all or substantially all of the length of the manifold and transports the recirculated fluid back to the fluid source or a different location.

In some applications, the fluid source is heated to maintain the fluid at a certain temperature above the ambient temperature, for example, to maintain a desired viscosity of the ink. Once the fluid flows through the printheads, the fluid can be returned to the same fluid source, such that the temperature can be maintained. Alternatively, the fluid can be returned to a different location, which may or may not be in fluid communication with the fluid source. For example, the fluid may be returned to a different location for changing out the color or type of fluid, purging of aged or degraded fluid, or replacement of the fluid with a cleaning or storage fluid.

Minimizing the number of connections in the fluid flow path between each printhead and the manifold 108 reduces the potential for leaks, which can be difficult to repair once the fluid ejection system 100 is assembled. Each printhead can be connected to the manifold 108 by a single inlet connection and, in implementations having recirculation, a single outlet connection.

Additionally, the overall length of the fluid flow path from the fluid inlet at each printhead to the inlet fluid duct can be minimized. Minimizing the length of the inlet fluid flow path can reduce the volume of fluid required to fill a printhead and provides less regions that may trap air, causing air bubbles in the fluid. In the implementation shown, the length of the fluid flow path from the inlet duct to the fluid inlet of the printhead is the length between points A and B. As compared to the height of the manifold, dimension "m" indicated by reference number 121, the length of the fluid flow path is less than 2 times m. In other implementations, for example, if the valves are positioned on a side surface of the manifold, the length of the flow path can be even shorter, e.g., approximately 1.5 times m.

Figure 3:
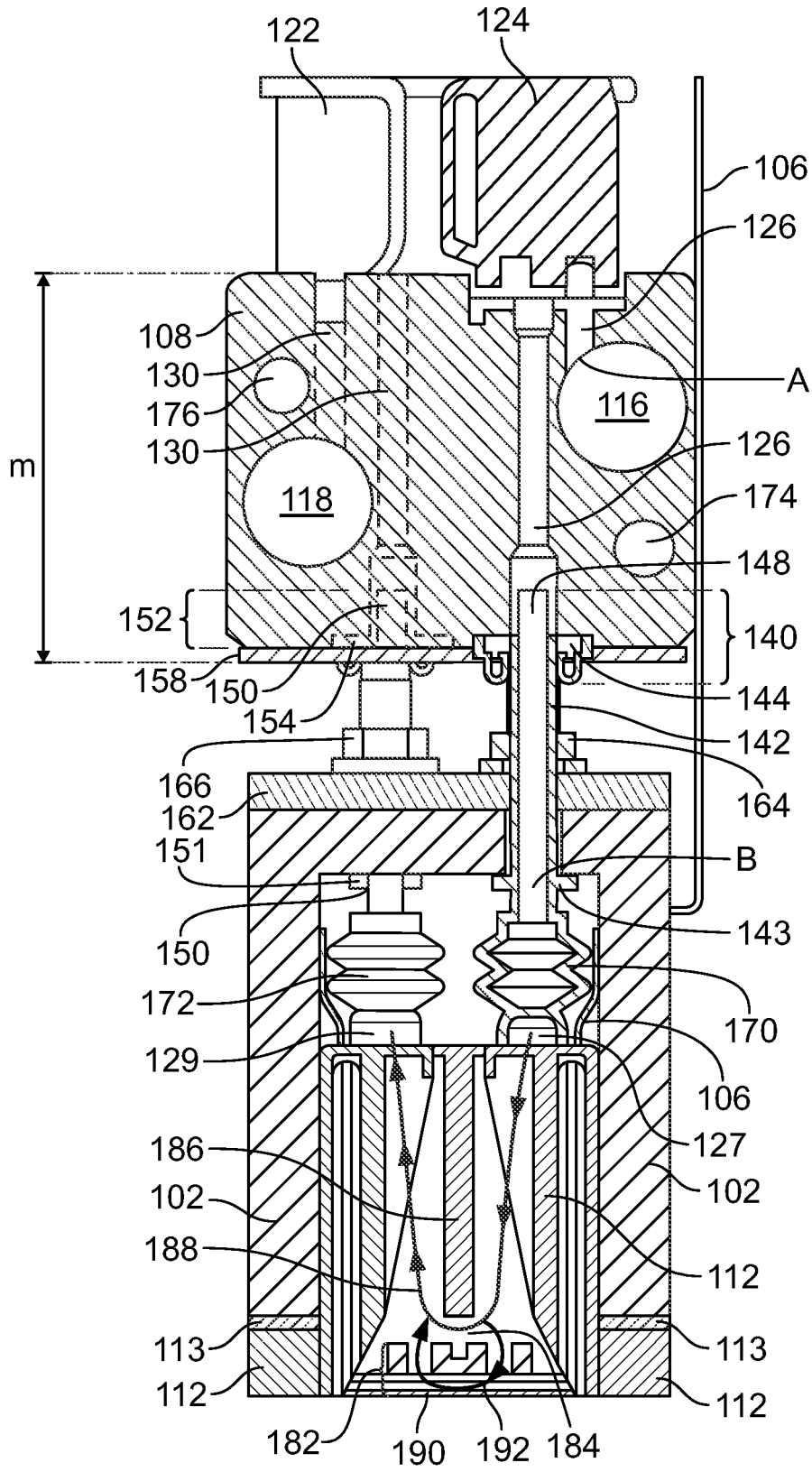
FIG. 3 is a cross-sectional view showing the example manifold of FIG. 1 connected to an example printhead.

FIG. 3 shows a cross-sectional view of a manifold 108 connected to an example printhead 112 with a single inlet connection 140 and a single outlet connection 152. The outlet connection 152 is shown in phantom, since the outlet fluid flow path is in a different plane than the inlet fluid flow path, which is shown. In this implementation, the printhead 112 includes an inlet tube 142 that extends out of the upper surface of the printhead 112 and into the manifold 108. A radial seal 144 is used to provide a fluid-tight, single inlet connection between the manifold 108 and the printhead 112. Other types of seals or connections can be used.

The printhead 112 also includes an outlet tube 150 that extends out of the upper surface of the printhead 112 and into the manifold 108. A radial seal 154 is used in this implementation to provide a fluid-tight, single outlet connection between the manifold 108 and the printhead 112, although other types of seals or connections can be used.

In this implementation, the proximal ends of the inlet and outlet tubes 142, 150 are integrally connected to, and are a part of, the printhead 112. The proximal end of the inlet tube 142 is fluidically connected to a fluid inlet port 127, and the proximal end of the outlet tube 150 is fluidically connected to a fluid outlet port 129. The distal ends of the inlet and outlet tubes 142, 150 extend into the manifold 108. The point at which the fluid flow enters the printhead 112 is labeled as point "B" and can be referred to as the fluid inlet of the printhead.

In an alternative implementation, the proximal ends of one or both of the inlet and outlet tubes 142, 150 are integrally connected to, and are a part of, the manifold 108, with the distal ends of the one or both tubes extending into the printhead 112. In any of these implementations, there are single inlet and outlet connections required between the manifold 108 and the printhead 112, thereby minimizing the risk of a leak. The tubes can be formed from a material that is compatible with the printing fluid that will be used in the printhead 112. For example, a corrosion resistant steel can be used. In other implementations, an injection molded chemical resistant plastic polymer is used, for example and without limitation: nylon, polypropylene, acetyl or liquid-crystal polymer (LCP) plastic resin.

Referring again to FIG. 3, in the implementation shown a seal clamp plate 158 is positioned on a lower surface of the manifold 108 and includes apertures to receive the radial seals 144 and 154. The radial seals 144, 154 are positioned within counter-bores in the manifold 108. The seal clamp plate 158 can be screwed to, or otherwise connected to, the manifold 108, thereby clamping the seals 144, 154 in place within the manifold 108. In some implementations, the seal clamp plate 158 is formed from metal, e.g., stainless steel, although in other implementations a different material, such as a plastic, can be used. Preferably, the material used for the seal clamp plate 158 is stiff so as to hold the seals 144, 154 in place.

A locating plate 162 can be positioned on an upper surface of the printhead 112 and include precisely located apertures to provide accurate locating of the inlet and outlet tubes 142, 150 relative to the apertures included in the seal clamp plate 158 to receive the inlet and outlet tubes 142, 150. The locating plate 162 can be formed from a substantially rigid material, for example, stainless steel or a plastic. A low expansion coefficient material such as Invar or Kovar for high accuracy requirements can be used. Invar is a nickel steel alloy, also known generically as 64FeNi. Kovar is an iron-nickel-cobalt alloy.

In the implementation shown, the connection between the printhead 112 by way of the inlet and outlet tubes 142, 150 and the manifold 108 is substantially rigid. Each tube 142, 150 includes a flange 143, 151 that is positioned to abut against a lower interior surface of the frame 102. A portion of the exterior of the inlet and outlet tubes 142, 150 includes threads, such that a nut can be threaded onto the exterior of each of the tubes 142, 150, i.e., nuts 164 and 166. When the nuts 164, 166 are tightened downwardly toward an upper surface of the locating plate 162, the flanges 143, 151 prevent the tubes 142, 150 from moving vertically upward, and the tubes 142, 150 are thereby secured rigidly in place relative to the locating plate 162 and the manifold 108.

Although a rigid connection between the printhead 112 and the manifold 108 is preferred, the inlet and outlet tubes 142, 150 can include compliant portions 170, 172 respectively to compensate for some amount of misalignment of the tubes 142, 150, relative to the apertures in the locating plate 162 through which they pass. The compliant portions allow some lateral movement of the proximal ends of the tubes 142, 150, thereby reducing stresses on the printhead 112, which can lead to misalignment of the printhead 112 itself, relative to adjacent printheads mounted to the frame 102. The compliant portions 170, 172 can be co-molded with the tubes 142, 150, i.e., be integral to the tubes, or can be bonded to a port in the printhead to which the tubes 142, 150 are connected. The tubes 142, 150 also pass through apertures formed in the upper portion of the frame 102. The apertures formed in the frame 102 are oversized so they do not dictate the positions of the tubes; the positions of the tubes are determined by the apertures in the locating plate 162. As discussed above, the apertures in the locating plate 162 can be precisely positioned to ensure alignment of the tubes relative to the manifold 108.

In the implementation of fluid ejection system shown, the frame 102 is a substantially U-shaped component, to which the printheads are mounted. In the example shown in FIG. 3, the printhead 112 includes winged portions at the lower end. The winged portions are affixed to plates 113, which can be formed from glass in some implementations. The plates 113 are affixed to the frame 102. In some implementations, the plates 113 are screwed to the frame 102, or otherwise affixed in a non-permanent manner, such that they can be removed. The winged portions of the printhead 112 are then permanently adhered to the plates 113, for example, using an adhesive. This technique for mounting a printhead to a frame is described in further detail in U.S. Provisional Patent Application 61/055,911 entitled "Method and Apparatus for Mounting a Fluid Ejection Module", filed May 23, 2008, by Kevin Von Essen, et al, the entire contents of which are hereby incorporated herein by reference.

In some implementations, the manifold 108 can be formed as a series of modules, where one module corresponds to one (or a group of) printheads 112. This allows any required number of manifold modules to be used to accommodate any number of printheads. In such implementations, threaded rods can extend the length of the series of manifold modules to secure them together. Referring again to FIG. 3, in the implementation shown, two rod-channels 174 and 176 are included and shown in cross-section, having a threaded interior surface. Two threaded rods can be threaded through the rod-channels 174, 176 to connect the manifold module shown to other manifold modules in series. Referring to FIG. 1, the ends of the two threaded rods 178, 180 are shown. Other techniques can be used to connect a series of manifold modules together, and the use of threaded rods is but one example. In other implementations, the manifold 108 is not modular, and is formed having a length selected to accommodate a particular set of printheads 112. In other implementations, the manifold 108 is not modular and is formed having a length that can later be trimmed to an appropriate size to accommodate a particular set of printheads 112.

The manifold 108 can be formed from machined metal, for example, stainless steel or aluminum. In other implementations, the manifold can be formed from injection molded plastic, for example, nylon, polypropylene or liquid-crystal-polymer (LCP) plastic resin. The inlet and outlet ducts can optionally be coated in a non-corrosive material. For example, if the manifold is formed from aluminum, the ducts can be nickel-plated to prevent corrosion. The materials used can vary, depending on the fluid being used in the fluid ejection system, and the above named materials are but a few examples.

The locating plate 162 can be precisely machined and can be formed from a material having a low coefficient of thermal expansion, to prevent the plate 162 from expanding and contracting due to temperature changes. Examples of suitable materials include, but are not limited to Invar and Kovar. In some implementations, to reduce the risk of misalignment of the locating plate 162 and the manifold 108 resulting from temperature variations, the locating plate 162 and manifold 108 can be formed from materials having substantially the same coefficients of thermal expansion.

Referring again to FIG. 3, a recirculation flow path in the example implementation of the printhead 112 is schematically represented. Fluid flowing into the printhead 112 is directed downwardly toward the printhead body 182. Some of the fluid, e.g., more than 50% and in some instances approximately 70%, flows through a gap 184 between a center rib 186 and printhead body 182. This fluid recirculates back up and out of the printhead 112 along path 188. The remaining fluid flows into the printhead body 182 and is directed into inlet passages to one or more pumping chambers included in the printhead body 182. Some of this fluid can be consumed by a printing operation, that is, ejected through one or more nozzles included in the nozzle plate 190. Any fluid not consumed in a print operation is recirculated out of the one or more pumping chambers, directed into one or more return channels and into the recirculation flow path 188 up and out of the printhead 112. Other configurations of printheads 112 and recirculation flow paths are possible, and the one described is but one illustrative example.

In one illustrative and non-limiting example, the printhead 112 can include a silicon printhead body 182 and one or more piezoelectric actuators. The printhead body can be made of silicon etched to define pumping chambers. Nozzles can be defined by a separate substrate (i.e., the nozzle plate 190) that is attached to the printhead body 182. The piezoelectric actuator can have a layer of piezoelectric material that changes geometry, or flexes, in response to an applied voltage. Flexing of the piezoelectric layer causes a membrane to flex, where the membrane forms a wall of the pumping chamber. Flexing the membrane thereby pressurizes ink in a pumping chamber located along the ink path and ejects an ink drop from a nozzle. The piezoelectric actuator can be bonded to the membrane.

Figure 4A:
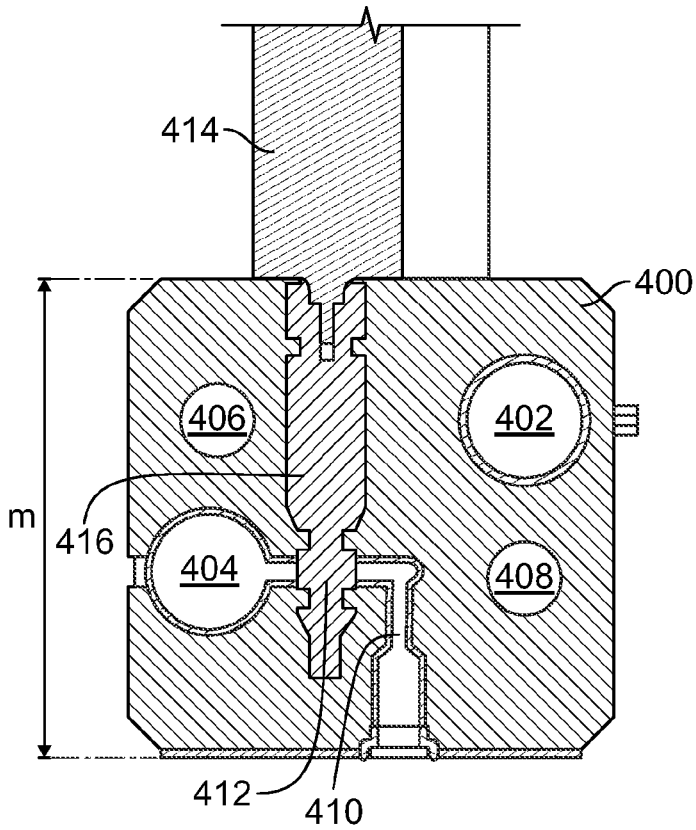
FIG. 4A is a cross-sectional view of an alternative manifold.

Referring to FIG. 4A, an alternative implementation of a manifold 400 is shown. In this implementation, the manifold 400 includes an inlet duct 402 and an outlet duct 404. The inlet duct 402 is positioned above the outlet duct 404 to provide a pressure differential between the two. Optionally, two rod-channels 406 and 408 can be included to receive threaded rods to attach the manifold 400 to other manifolds in series. FIG. 4A shows a cross-sectional view of the manifold 400, where the cross-section is taken in a plane intersecting the fluid outlet channel 410. The fluid inlet channel is not visible in this cross-sectional view.

In this implementation, rather than have the fluid outlet channel route the printing fluid through a valve positioned on top of the manifold, as is the case in the implementation shown in FIG. 3, a valve 412 is included within the manifold 400 in relatively close proximity to the outlet duct 404. The valve 412 is controlled by a motor 414 that is positioned on an upper exterior surface of the manifold 400. In other implementations, the motor can be positioned on a side surface of the manifold 400 or integrated within the manifold itself. The valve 412 can be any valve 412 controllable by a motor, for example, a ball valve or a servo valve. A drive shaft 416 from the motor 414 extends through the manifold 400 to the valve 412 and can be used to drive the valve 412 between opened, closed and, in some implementations, partially opened positions. In some implementations, the motor 414 can be a motor with a gear reduction, or a high torque stepper motor to provide high torque and low speed to rotate the valve with seal friction. Other types of motors can be used.

Although not visible in the cross-sectional view shown, a second motor can control a second valve positioned within the manifold 400 in close proximity to the fluid inlet duct 402 to control fluid flow from the inlet duct 402 to the fluid inlet channel.

Advantageously, positioning the valves within the manifold 400 and in close proximity to the inlet and outlet ducts 402, 404 reduces the length of the flow path within the manifold 400. The shorter the fluid path, the less printing fluid required within the system and the risk of air entrapment within the fluid path is reduced. Additionally, the valve can be a proportional valve, that is, have one or more positions between open and closed positions. In some applications, it may be desirable to adjust the fluid flow, for example, based on the viscosity of the fluid, by using an intermediate position of one or both valves.

Figure 4B:
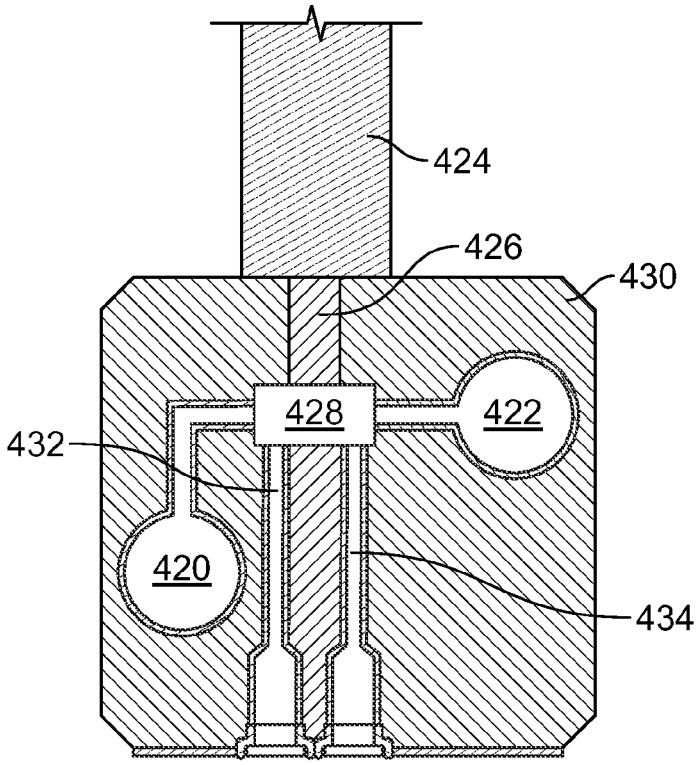
FIG. 4B is a cross-sectional view of another alternative manifold.

Referring to FIG. 4B, in other implementations, a single motor 424 can be used to control a valve 428 that can control fluid flow in both the fluid inlet channel 434 and the fluid outlet channel 432. In the manifold 430 shown in FIG. 4B, the inlet 422 and the outlet duct 420 are both connected to the valve 428 driven by a drive shaft 426 connected to the motor 424. One example valve 428 is a spool valve; the spool valve can include multiple positions, e.g., (1) both the inlet and outlet open; (2) both the inlet and outlet closed; (3) the inlet open and the outlet closed; and (4) the inlet closed and the outlet open. In some implementations, there can be additional positions to partially open each of the inlet and outlet valves.

Figure 5:
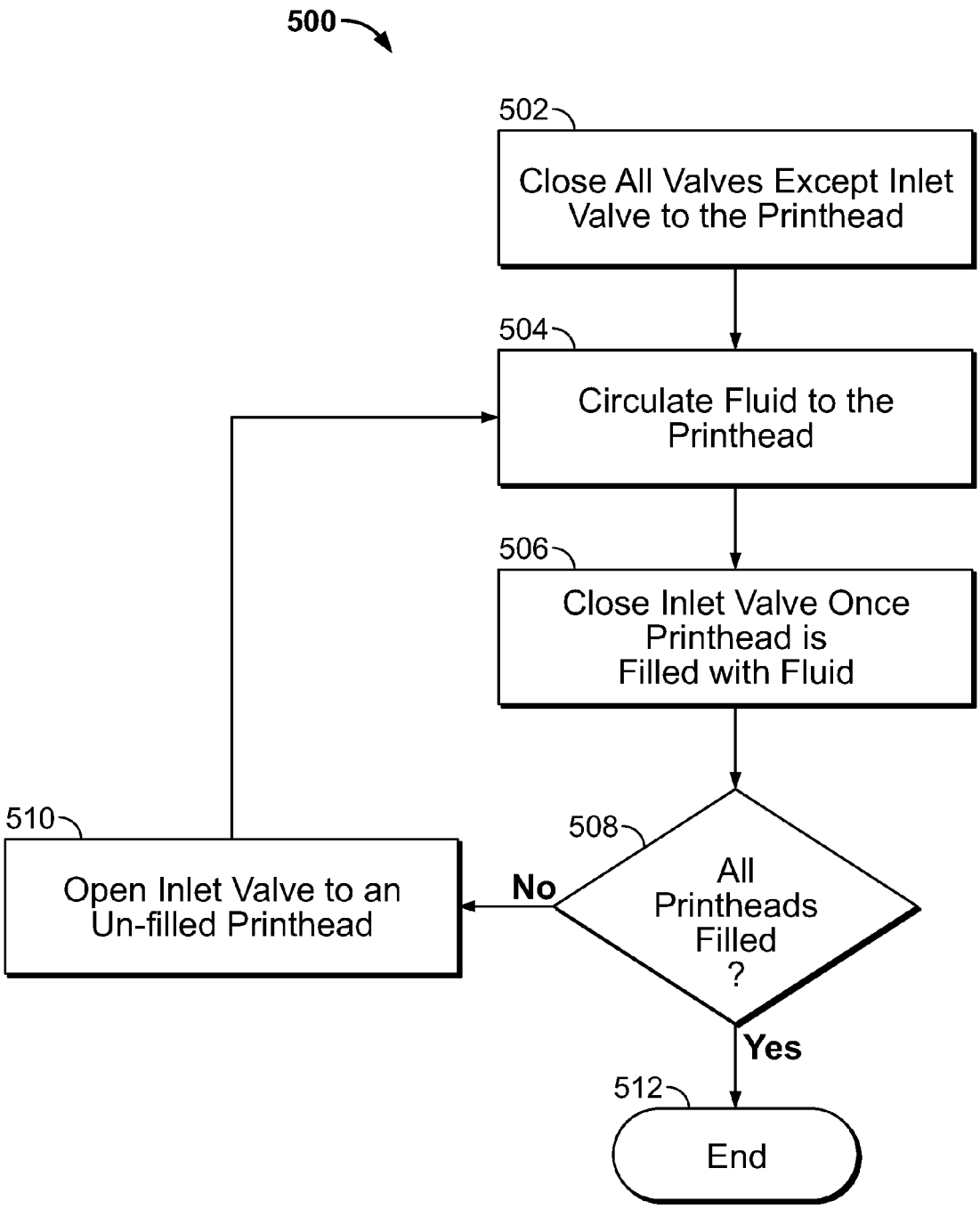
FIG. 5 is a flowchart showing a process for filling printheads connected to a manifold.

Referring to FIG. 5, a flowchart shows a process 500 for filling a series of printheads connected to a manifold. By way of example, the printheads shown attached to the modular manifold 108 in FIG. 1 can be filled with a printing fluid using this process 500. The process 500 can be implemented using, by way of example, the manifold 108 shown in FIG. 3 or the manifold 400 shown in FIG. 4. For illustrative purposes, the process 500 shall be described here in reference to the manifold 108 and printhead 112 shown in FIG. 3, although it should be understood that the process 500 can be used with other configurations of manifold and printhead.

All inlet and outlet valves included in the manifold 108 are initially closed, with the exception of the inlet valve to the one printhead that is being filled, e.g., printhead 112 (step 502). Fluid is circulated from the inlet duct 116 through the fluid inlet channel 126 and into the printhead 112 via the inlet tube 142 (step 504). Once the printhead 112 is filled with fluid, the inlet valve corresponding to the printhead 112 is closed (step 506). If all of the printheads connected to the manifold 108 are filled ("Yes" branch of decision step 508), then the process ends (step 512). Otherwise, if not all the printheads are filled ("No" branch of decision step 508), then an inlet valve to an un-filled printhead is opened (step 510) and the process loops back to step 504, i.e., circulating fluid to the printhead. The process 500 continues until all of the printheads connected to the manifold 108 are filled. In some implementations, through testing a fill time can be determined that reliably filled the system with fluid and purged all air. Filling the system may require a high pressure, low pressure or a combination of high and low pressure changes to achieve fill with air purged.

Figure 6:
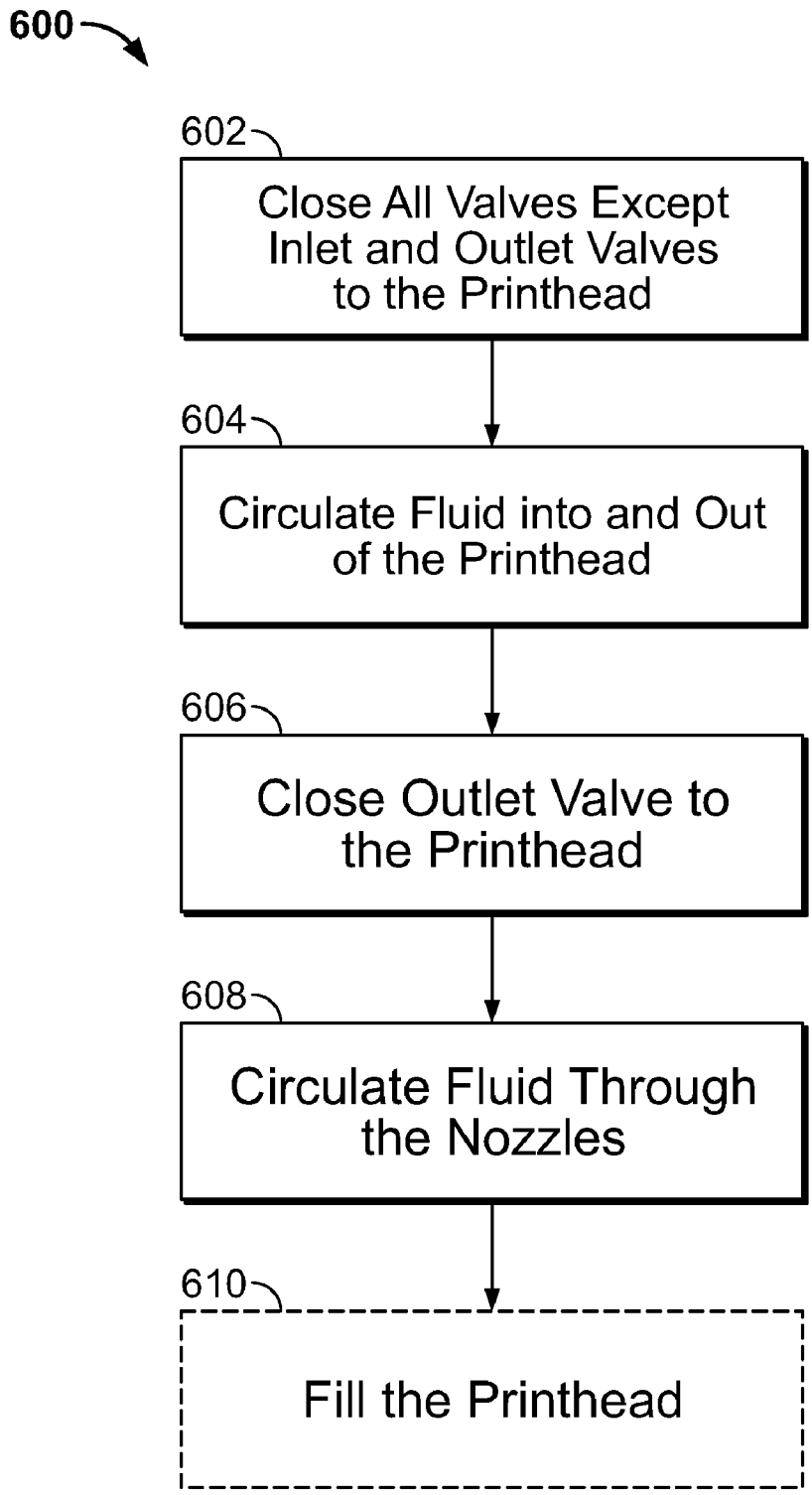
FIG. 6 is a flowchart showing a process for performing a maintenance operation on a printhead connected to a manifold.

Referring to FIG. 6, a process 600 is shown for providing maintenance to a printhead connected to a manifold. For illustrative purposes, the process 600 shall be described with reference to the manifold 108 and printhead 112 shown in FIG. 3, although it should be understood that the process 600 can be used with other configurations of manifold and printhead. The process 600 can be used to remove air bubbles and/or to purge contaminants from the fluid path within the manifold 108 and printhead 112. Initially, all valves in the manifold 108 are closed with the exception of the inlet and outlet valves corresponding to the printhead subject of the maintenance operation, e.g., printhead 112 (step 602). Fluid is circulated into and out of the printhead 112 (step 604). That is, fluid from the inlet duct 116 travels up the fluid inlet channel 126 into and through the solenoid valve 124 and down the fluid inlet channel 126 into the inlet tube 142 of the printhead 112. The fluid circulates through the printhead 112 with some of the fluid being expelled from the nozzles and the remainder traveling up the outlet tube 150 into the fluid outlet channel 130 in the manifold 108, passing through the open valve 122 and down the fluid outlet channel 130 into the outlet duct 118.

The outlet valve 122 to the printhead 112 is then closed (step 606). Fluid is continued to be circulated to the printhead 112, and since the outlet valve 122 is now closed, the fluid is forced out of the nozzles of the printhead 112 at a relatively high pressure (step 608). The high pressure flow of fluid through the nozzles forces air or other fluids out of the nozzles. Once the maintenance process is complete and the printhead 112 is filled with fluid (step 610), then either the outlet valve 122 can be reopened, e.g., if a printing operation is to commence, or the inlet valve 124 can be closed, e.g., if no printing operation is scheduled. Closing both the inlet and outlet valves to the printhead when the printhead is in a non-operating state can prevent leakage of fluid, e.g., from the nozzles. In some implementations, when power to a fluid ejection system including the manifold/printhead assembly is off, the valves are automatically closed and when the power is on, the valves are automatically opened.

In some implementations, during operation, the circulation flow rate through the printhead can be selected based on heat loss assumptions caused by ambient and printing conditions, such that enough flow is provided to maintain a substantially constant printhead temperature, using the high flow circulating fluid path as the heating source. A second flow rate requirement can be to provide for proper flow through the one or more pumping chambers included in the printhead body and across each nozzle opening, to prevent the drying of fluid in the nozzle openings. This flow rate is through the second flow path (i.e., path 192 shown in FIG. 3) and can be a value dependant on restrictions created by the precise inlet and outlet geometry for each pumping chamber.

The use of terminology such as "front" and "back" and "top" and "bottom" throughout the specification is to illustrate the positioning and orientation of elements of the printhead relative to each other, and do not imply a particular orientation relative to gravity. Similarly, the use of horizontal and vertical to describe elements throughout the specification is in relation to the implementation described. In other implementations, the same or similar elements can be orientated other than horizontally or vertically as the case may be.

A number of embodiments of the invention have been described. Nevertheless, it will be understood that various modifications may be made without departing from the spirit and scope of the invention. Accordingly, other embodiments are within the scope of the following claims.

What is claimed is:

1. A printhead assembly comprising:

a plurality of printheads, where each printhead includes:

a fluid inlet to receive fluid into the printhead; and a set of one or more nozzles to deposit fluid on a substrate;

a manifold connected to the plurality of printheads including:

a fluid inlet duct configured to receive fluid for delivery to the printheads;

a plurality of fluid inlet channels, each fluid inlet channel connecting the fluid inlet duct to one of the printheads; and a plurality of fluid inlet valves, each valve configured to control a flow of fluid from the fluid inlet duct to one of the fluid inlet channels; and a plurality of inlet tubes, each inlet tube having a proximal end integral to either the manifold or one of the printheads and a distal end connected to either the manifold or said printhead with a fluid-tight connection, where each inlet tube connects a fluid inlet channel of the manifold to a fluid inlet of said printhead with a single fluid-tight connection.

2. The printhead assembly of claim 1, wherein:

the manifold has a dimension m in a direction parallel to a length dimension of the plurality of inlet tubes; and a length of a flow path extending from the fluid inlet duct to the fluid inlet of each printhead does not exceed approximately one-and-a-half times the dimension m.

3. The printhead assembly of claim 1, wherein:

the manifold has a dimension m in a direction parallel to a length dimension of the plurality of inlet tubes; and a length of a flow path extending from the fluid inlet duct to the fluid inlet of each printhead does not exceed approximately two times the dimension m.

4. The printhead assembly of claim 1, wherein:

each inlet tube has the proximal end formed integral to one of the printheads and a radial seal provides a fluid-tight connection between the distal end of each inlet tube and the manifold.

5. The printhead assembly of claim 1, wherein:

each inlet tube has the proximal end formed integral to the manifold and a radial seal provides a fluid-tight connection between the distal end of each inlet tube and one of the printheads.

6. The printhead assembly of claim 1, wherein:

each of the plurality of fluid inlet valves comprises a solenoid valve.

7. The printhead assembly of claim 6, wherein at least some of the solenoid valves are connected to a first surface of the manifold that is positioned opposite a second surface of the manifold that is connected to the printheads.

8. The printhead assembly of claim 6, wherein at least some of the solenoid valves are connected to a first surface of the manifold that is positioned substantially perpendicular to a second surface of the manifold that is connected to the printheads.

9. The printhead assembly of claim 1, further comprising:

a plurality of inlet motors, each inlet motor controlling one of the fluid inlet valves.

10. The printhead assembly of claim 9, where each fluid inlet valve comprises a ball valve.

11. The printhead assembly of claim 9, where each fluid inlet valve comprises a servo valve.

12. A printhead assembly comprising:

a plurality of printheads, where each printhead includes:

a fluid inlet to receive fluid into the printhead;

a set of one or more nozzles to deposit fluid on a substrate; and a fluid outlet to remove fluid from the printhead;

a manifold connected to the plurality of printheads including:

a fluid inlet duct configured to receive fluid for delivery to the printheads;

a fluid outlet duct configured to receive fluid from the printheads;

a plurality of fluid inlet channels, each fluid inlet channel connecting the fluid inlet duct to one of the printheads;

a plurality of fluid outlet channels, each fluid outlet channel connecting the fluid outlet duct to one of the printheads;

a plurality of fluid inlet valves, each valve configured to control a flow of fluid from the fluid inlet duct to one of the fluid inlet channels; and a plurality of fluid outlet valves, each valve configured to control a flow of fluid from the fluid outlet duct to one of the fluid outlet channels;

a plurality of inlet tubes, each inlet tube having a proximal end integral to either the manifold or one of the printheads and a distal end connected to either the manifold or said printhead with a fluid-tight connection, where each inlet tube connects a fluid inlet channel of the manifold to a fluid inlet of one of the printheads with a single fluid-tight connection; and a plurality of outlet tubes, each outlet tube having a proximal end integral to either the manifold or one of the printheads and a distal end connected to either the manifold or said printhead with a fluid-tight connection, where each outlet tube connects a fluid outlet channel of the manifold to a fluid outlet of one of the printheads with a single fluid-tight connection.

13. The printhead assembly of claim 12, wherein:

the manifold has a dimension m in a direction parallel to a length dimension of the plurality of inlet tubes; and a length of a flow path extending from the fluid inlet duct to the fluid inlet of each printhead does not exceed approximately one-and-a-half times the dimension m.

14. The printhead assembly of claim 12, wherein:

the manifold has a dimension m in a direction parallel to a length dimension of the plurality of inlet tubes; and a length of a flow path extending from the fluid inlet duct to the fluid inlet of each printhead does not exceed approximately two times the dimension m.

15. The printhead assembly of claim 12, wherein:

the fluid inlet duct is positioned above the fluid outlet duct such that a pressure differential exists between the fluid inlet and outlet ducts.

* * * * *